US005632789A

United States Patent [19]

Ryoke et al.

[11] Patent Number: 5,632,789

[45] Date of Patent: May 27, 1997

[54] ABRASIVE TAPE

[75] Inventors: Katsumi Ryoke; Kazuko Hanai; Masaaki Fujiyama, all of Kanagawa-ken, Japan

[73] Assignee: Fuji Photo Film Co., Ltd., Kanagawa, Japan

[21] Appl. No.: 575,017

[22] Filed: Dec. 19, 1995

[30] Foreign Application Priority Data

Feb. 16, 1995 [JP] Japan ..... 7-028227

[51] Int. Cl.[6] ..... B24D 3/34

[52] U.S. Cl. ..... 51/295; 51/304; 51/309

[58] Field of Search ..... 51/295, 304, 309

[56] References Cited

U.S. PATENT DOCUMENTS

| | | | |
|---|---|---|---|
| 4,590,127 | 5/1986 | Hashimoto et al. | 428/405 |
| 4,740,423 | 4/1988 | Kadokura et al. | 51/304 |
| 5,456,734 | 10/1995 | Ryoke et al. | 51/295 |
| 5,573,444 | 11/1996 | Ryoke et al. | 451/28 |

*Primary Examiner*—Deborah Jones
*Attorney, Agent, or Firm*—Sughrue, Mion, Zinn, Macpeak & Seas

[57] ABSTRACT

An abrasive tape comprises a substrate and an abrasive layer, which is overlaid on the substrate and is constituted of fine abrasive grains and a binder, wherein the abrasive layer contains an alkyl sulfosuccinic acid salt ester. The abrasive tape gives little scratching and little chipping to materials to be abraded and has a sufficiently high abrasive powder.

11 Claims, 1 Drawing Sheet

ABRASIVE TAPE

BACKGROUND OF THE INVENTION

1. Field of the Invention

This invention relates to an abrasive tape to be used for abrasive processing or cleaning of magnetic heads for magnetic recording and reproducing apparatuses and ceramic materials, and to be used for abrasive processing, cleaning, polishing, burnishing, or texturing of various materials.

2. Description of the Prior Art

Abrasive tapes comprising a non-magnetic substrate and an abrasive layer, which is overlaid on the substrate and is constituted of fine abrasive grains and a binder, have heretofore been used widely in abrasive processing or cleaning of magnetic heads for magnetic recording and reproducing apparatuses. The abrasive tapes of this type are also used widely for, for example, a texturing process, with which fine "stripes" are formed on the surface of a hard disk substrate in order to prevent the hard disk in use from sticking to the magnetic head.

In cases where materials to be abraded, such as magnetic heads, ceramic materials, hard disk substrates, ferrite materials, and amorphous materials, are subjected to the abrasive processing, cleaning, texturing, polishing, burnishing, or the like, in which the abrasive tapes are used, scratching flaws ordinarily referred to as the scratches often occur on the materials to be abraded. Also, in particular, in cases where the materials to be abraded are brittle as in ceramic materials, chipping often occurs on the materials to be abraded. (All of the abrasive processing, cleaning, texturing, polishing, burnishing, and the like, belong to the abrasive processing in the broad sense. Therefore, unless otherwise specified, the term "abrasive processing" as used hereinafter means the abrasive processing in the broad sense.)

In order for the scratches and the chipping to be prevented from occurring, it is effective to wet the abrasive tape or material to be abraded by using a coolant liquid or water during the abrasive processing. However, in such cases, the abrasive powder becomes low.

SUMMARY OF THE INVENTION

The primary object of the present invention is to provide an abrasive tape, which is free of the problems with regard to scratches and chipping of materials to be abraded and which has a sufficiently high abrasive powder.

Another object of the present invention is to provide an abrasive tape, which has good frictional characteristics.

The present invention provides a first abrasive tape comprising a substrate and an abrasive layer, which is overlaid on the substrate and is constituted of fine abrasive grains and a binder, wherein the abrasive layer contains an alkyl sulfosuccinic acid salt ester.

Examples of the salts include the salts of alkali metals (specifically, Li, Na, K, and the like), and the salts of alkaline earth metals (specifically, Ba, Ca, and the like).

The present invention also provides a second abrasive tape, wherein the alkyl group in the alkyl sulfosuccinic acid salt ester has 3 to 10 carbon atoms.

The present invention further provides a third abrasive tape, wherein the alkyl sulfosuccinic acid salt ester is dioctyl sodium sulfosuccinate, and dioctyl sodium sulfosuccinate is contained in a proportion falling within the range of 0.1 to 2.0 parts by weight per 100 parts by weight of the fine abrasive grains.

With the first abrasive tape in accordance with the present invention, the alkyl sulfosuccinic acid salt ester imparts wetting characteristics to the abrasive tape. Therefore, with the abrasive tape in accordance with the present invention, a high abrasive powder can be obtained, and scratches and chipping can be prevented from occurring on the material to be abraded.

With the second abrasive tape in accordance with the present invention, wherein the alkyl group in the alkyl sulfosuccinic acid salt ester has 3 to 10 carbon atoms, the level of the hydrophilic characteristics of the abrasive tape can be adjusted, and good frictional characteristics of the abrasive tape can be obtained.

With the third abrasive tape in accordance with the present invention, wherein the alkyl sulfosuccinic acid salt ester is dialkyl sodium sulfosuccinate such as dioctyl sodium sulfosuccinate, and dioctyl sodium sulfosuccinate is contained in a proportion falling within the range of 0.1 to 2.0 parts by weight per 100 parts by weight of the fine abrasive grains, particularly good abrasive effects can be obtained as will be later described in detail in examples.

DETAILED DESCRIPTION OF THE INVENTION

Figure 1:
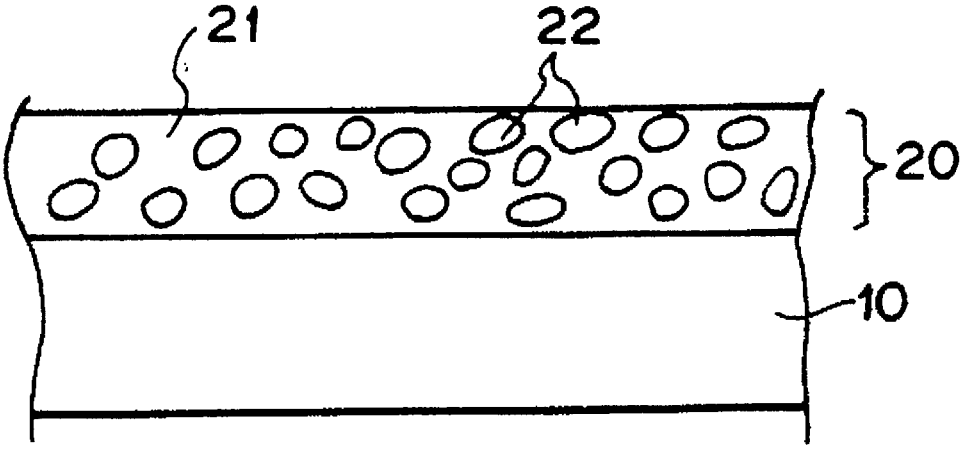
FIG. 1 is a schematic view showing an embodiment of the abrasive tape in accordance with the present invention.

The fine abrasive grains, which can be employed as the primary constituent material of the abrasive layer in the abrasive tape in accordance with the present invention, should preferably have a mean grain size falling within the range of 0.05 μm to 10 μm. Preferred examples of the materials for the fine abrasive grains include α-alumina, γ-alumina, fused alumina, chromium oxide, silicon carbide, non-magnetic iron oxide, diamond, artificial (synthetic) diamond, cerium oxide, corundum, garnet, emery (major constituents: corundum and magnetite), silica, silicon nitride, boron nitride, molybdenum carbide, boron carbide, tungsten carbide, and titanium carbide. Ordinarily, as the fine abrasive grains, the materials having a Mohs hardness of not less than 6 are used alone, or two to four kinds of the materials are used in combination. The pH value of the fine abrasive grains should preferably fall within the range of 2 to 10, and should more preferably fall within the range of 5 to 10.

For the purposes of prevention of electrostatic charging, enhancement of light blocking, regulation of the friction coefficient, and enhancement of the durability, the abrasive layer may further contain a carbon black, such as furnace black for rubber, thermal black for rubber, coloring black, or acetylene black. Examples of these carbon black materials include, expressed by acronyms referred to in United States, SAF, ISAF, IISAF, T, HAF, SPF, FF, FFF, HMF, GPF, APF, SRF, MPF, ECF, SCF, CF, FT, MT, HCC, HCF, MSF, LFF, and RCF. The carbon black materials classified in the ASTM Standard, D-1765-82a, may be employed. The carbon black employed in the abrasive tape in accordance with the present invention may have a mean grain size falling within the range of 5 nm to 1,000 nm (as measured with an electron microscope), a specific surface area falling within the range of $1m^2/g$ to $800m^2/g$ (as measured with the nitrogen adsorption method), a pH value falling within the range of 4 to 11 (as measured with the JIS K-6221-1982 method), and a dibutyl phthalate (DBP) oil absorption falling within the range of 10 ml/100 g to 800 ml/100 g (as measured with the JIS K-6221-1982 method). In the abrasive tape in accordance with the present invention, in order to decrease the surface electrical resistance of the abrasive layer coating film, a carbon black having a grain diameter falling within the range of 5 nm to 100 nm may be employed. Also, in cases where the strength of the abrasive layer coating film is to be controlled, a carbon black having a grain diameter falling within the range of 50 nm to 1,000 nm may be employed. Further, in cases where the surface roughness of the abrasive layer coating film is to be controlled, such that the surface may be smoothed in order to reduce the spacing loss, finer carbon black grains (having a grain diameter of smaller than 100 nm) may be employed. Alternatively, such that the surface of the abrasive layer coating film may be toughened in order to reduce the friction coefficient, coarser carbon black grains (having a grain diameter of at least 100 nm) may be employed.

Thus the kind of the carbon black and the amount of the carbon black added are selected in accordance with the characteristics which the abrasive tape is required to have. The carbon black may be subjected to surface treatment with a dispersing agent, which will be described later, or the like, or may be grafted with a resin. It is also possible to employ a carbon black having been treated at a furnace temperature of at least 2,000° C. during the production of the carbon black such that a portion of the carbon black surface may be graphitized. Further, as a specific carbon black, a hollow carbon black may be employed. The carbon black should preferably be added in proportions falling within the range of 0.1 to 100 parts by weight per 100 parts by weight of the inorganic grains of the abrasive layer.

In cases where the carbon black is employed in a backing layer, it should preferably be added in proportions falling within the range of 20 to 400 parts by weight per 100 parts by weight of a resin which will be described later. As for the carbon black which may be employed in the abrasive tape in accordance with the present invention, reference may be made to, for example, "Carbon Black Handbook," published by Carbon Black Society, 1971.

As the binder contained in the abrasive layer of the abrasive tape in accordance with the present invention, any of binders known in the art may be used. Examples of these binders include thermoplastic resins, thermosetting resins, reactive resins, electron beam-curing resins, ultraviolet-curing resins, visible light-curing resins, and mixtures of two or more of these resins.

The thermoplastic resins, which may be used as the binder in the abrasive layer of the abrasive tape in accordance with the present invention, generally have a softening point of 150° C. or lower, an average molecular weight falling within the range of approximately 10,000 to approximately 300,000, and a polymerization degree falling within the range of approximately 50 to approximately 2,000. The polymerization degrees of the thermoplastic resins should preferably fall within the range of approximately 200 to approximately 700. Specifically, as the thermoplastic resin, it is possible to use, for example, a vinyl chloride-vinyl acetate copolymer, a vinyl chloride copolymer, a vinyl chloride-vinyl acetate-vinyl alcohol copolymer, a vinyl chloride-vinyl alcohol copolymer, a vinyl chloride-vinylidene chloride copolymer, a vinyl chloride-acrylonitrile copolymer, an acrylic ester-acrylonitrile copolymer, an acrylic ester-vinylidene chloride copolymer, an acrylic ester-styrene copolymer, a methacrylic ester-acrylonitrile copolymer, a methacrylic ester-vinylidene chloride copolymer, a methacrylic ester-styrene copolymer, a urethane elastomer, a nylon-silicone resin, a nitrocellulose-polyamide resin, polyvinyl fluoride resin, a vinylidene chloride-acrylonitrile copolymer, a butadiene-acrylonitrile copolymer, a polyamide resin, a polyvinyl butyral resin, a cellulose derivative (such as cellulose acetate butyrate, cellulose diacetate, cellulose triacetate, cellulose propionate, nitrocellulose, ethyl cellulose, methyl cellulose, propyl cellulose, methyl ethyl cellulose, carboxymethyl cellulose, or acetyl cellulose), a styrene-butadiene copolymer, a polyester resin, a polycarbonate resin, a chlorovinyl ether-acrylic ester copolymer, an amino resin, a synthetic rubber type thermoplastic resin, or a mixture of two or more of these compounds.

As the thermosetting resins or the reactive resins, which may be used as the binder in the abrasive layer of the abrasive tape in accordance with the present invention, there should preferably employed the resins, which have a molecular weight of 200,000 or less when the resins takes on the form of coating compositions, and which exhibit an infinite increase in the molecular weight through the condensation reactions, the addition reactions, or the like, when the coating compositions are heated and humidified after being applied onto substrates and dried. Among these resins, the resins, which do not soften or melt before they decompose thermally, should more preferably be employed. Specifically, examples of the thermosetting resins or the reactive resins include a phenol resin, a phenoxy resin, an epoxy resin, a polyurethane resin, a polyester resin, a polyurethane polycarbonate resin, a urea resin, a melamine resin, an alkyd resin, a silicone resin, an acrylic reactive resin (an electron beam-curing resin), an epoxy-polyamide resin, a nitrocellulose melamine resin, a mixture of a high-molecular weight polyester resin with an isocyanate prepolymer, a mixture of a methacrylate copolymer with a diisocyanate prepolymer, a mixture of a polyester polyol with a polyisocyanate, a urea-formaldehyde resin, a mixture of a low-molecular weight glycol, a high-molecular weight diol and a triphenylmethane triisocyanate, a polyamine resin, a polyimine resin, and a mixture of two or more of these compounds.

In general, the thermoplastic resins, the thermosetting resins, and the reactive resins described above respectively have their major functional groups, and one to six kinds of other functional groups. Each of the other functional groups should preferably be contained in proportions within the range of $1\times10^{-6}$ equivalent to $1\times10^{-2}$ equivalent per gram of the resin. Examples of the other functional groups include acid groups, such as a carboxylic acid group (COOM), a sulfinic acid group, a sulfenic acid group, a sulfonic acid group ($SO_3M$), a phosphoric acid group [PO(OM)(OM)], a phosphonic acid group, a sulfuric acid group ($OSO_3M$), and ester groups with these acids, wherein M represents H, an alkali metal, an alkaline earth metal, or a hydrocarbon group; groups of amphoteric compounds, such as a group of an amino acid, a group of an aminosulfonic acid, a group of a sulfuric ester of amino-alcohol, a group of a phosphoric ester of amino-alcohol, a sulfobetaine form group, a phosphobetaine form group, and an alkyl betaine form group; basic groups, such as an amino group, an imino group, an imido group, and an amido group; a hydroxyl group; an alkoxyl group; a thiol group; an alkylthio group; halogen groups, such as F, Cl, Br, and I; a silyl group; a siloxane group; an epoxy group; an isocyanato group; a cyano group; a nitrile group; an oxo group; an acryl group; and a phosphine group.

In the abrasive tape in accordance with the present invention, the above-enumerated binders are used alone, or two or more of them are used in combination. Also, the other additives are added to the abrasive layer, when necessary.

The binder is contained in the abrasive layer in a proportion falling within the range of 5 to 70 parts by weight per 100 parts by weight of the fine abrasive grains. As for the mixing proportions of fine grains and the binder in the backing layer, the binder may be contained in the backing layer in a proportion falling within the range of 8 to 400 parts by weight per 100 parts by weight of the fine grains. Examples of the additives include a dispersing agent, a lubricating agent, an antistatic agent, an antioxidant, a mildew-proofing agent, a coloring agent, and a solvent.

In the abrasive layer of the abrasive tape in accordance with the present invention, polyisocyanates may be contained as hardeners. As the polyisocyanates, it is possible to use, for example, isocyanates, such as tolylene diisocyanate, 4,4'-diphenylmethane diisocyanate, hexamethylene diisocyanate, xylylene diisocyanate, naphthylene-1,5-diisocyanate, o-toluidine diisocyanate, isophorone diisocyanate, and triphenylmethane triisocyanate. As the polyisocyanates, it is also possible to use products of reactions between the above-enumerated isocyanates and polyalcohols, and dimer to decamer polyisocyanates produced from condensation of isocyanates, and products which are obtained from reactions between polyisocyanates and polyurethanes and which have isocyanate groups as terminal functional groups. The polyisocyanates enumerated above should preferably have an average molecular weight falling within the range of 100 to 20,000.

Such polyisocyanates are commercially available as, for example, Coronate L, Coronate HL, Coronate 2030, Coronate 2031, Myrionate MR, and Myrionate MTL (supplied by Nippon Polyurethane K. K.); Takenate D-102, Takenate D-110N, Takenate D-200, Takenate D-202, Takenate 300S, and Takenate 500 (supplied by Takeda Chemical Industries, Ltd.); Sumidur T-80, Sumidur 44S, Sumidur PF, Sumidur L, Sumidur N, Desmodur L, Desmodur IL, Desmodur N, Desmodur HL, Desmodur T65, Desmodur 15, Desmodur R, Desmodur RF, Desmodur SL, and Desmodur Z4273 (supplied by Sumitomo Bayer K. K.). These polyisocyanates may be used alone, or a mixture of two or more of them may be used by the utilization of differences in curing reaction properties.

Also, in order to promote the curing reaction, compounds having a hydroxyl group (such as butanediol, hexanediol, polyurethane having a molecular weight within the range of 1,000 to 10,000, and water), compounds having an amino group (such as monomethylamine, dimethylamine, and trimethylamine), catalysts, such as metal oxides and iron acetylacetonate, may be used together with the polyisocyanates. The compounds having a hydroxyl group or an amino group should preferably be polyfunctional. The proportions of the polyisocyanate used should preferably fall within the range of 2 to 70 parts by weight per 100 parts by weight of the total of the binder and the polyisocyanate, and should more preferably fall within the range of 5 to 50 parts by weight per 100 parts by weight of the total of the binder and the polyisocyanate.

Examples of the powdered lubricating agents, which may be employed in the abrasive layer of the abrasive tape in accordance with the present invention, include fine grains of inorganic materials, such as graphite, molybdenum disulfide, boron nitride, graphite fluoride, calcium carbonate, barium sulfate, silicon oxide, titanium oxide, zinc oxide, tin oxide, and tungsten disulfide; and fine grains of resins, such as an acryl-styrene resin, a benzoguanamine resin, a melamine resin, a polyolefin resin, a polyester resin, a polyamide resin, a polyimide resin, and a polyfluoroethylene resin.

As the lubricating agents, various organic compounds may also be employed. Examples of such organic compounds include compounds into which fluorine or silicon is introduced, such as a silicone oil (e.g., a dialkyl polysiloxane, a dialkoxy polysiloxane, a phenyl polysiloxane, or a fluoroalkyl polysiloxane, which is supplied as KF96, KF69, or the like, by Shin-Etsu Chemical Co., Ltd.), a fatty acid-modified silicone oil, a fluorine alcohol, a polyolefin (e.g., a polyethylene wax or a polypropylene), a polyglycol (e.g., ethylene glycol or a polyethylene oxide wax), a tetrafluoroethylene oxide wax, a polytetrafluoroglycol, a perfluoroalkyl ether, a perfluorofatty acid, a perfluorofatty acid ester, a perfluoroalkylsulfuric ester, a perfluoroalkylsulfonic ester, a perfluoroalkylbenzenesulfonic ester, and a perfluoroalkylphosphoric ester; organic acids and organic acid ester compounds, such as an alkylsulfuric ester, an alkylsulfonic ester, an alkylphosphonic triester, an alkylphosphonic monoester, an alkylphosphonic diester, an alkylphosphoric ester, and a succinic ester; heterocyclic compounds containing nitrogen or sulfur, such as triazaindolizine, tetraazaindene, benzotriazole, benzotriazine, benzodiazole, and EDTA; a fatty acid ester of a monobasic fatty acid having 10 to 40 carbon atoms with one or at least two of a monohydric alcohol, a dihydric alcohol, a trihydric alcohol, a tetrahydric alcohol and a hexahydric alcohol, each alcohol having 2 to 40 carbon atoms; a fatty acid ester of a monobasic fatty acid having at least 10 carbon atoms with such an monohydric, dihydric, trihydric, tetrahydric, pentahydric or hexahydric alcohol that the sum of the number of the carbon atoms of the fatty acid and the number of the carbon atoms of the alcohol may fall within the range of 11 to 70; and fatty acids, fatty acid amides, fatty acid alkyl amides, and aliphatic alcohols, which have 8 to 40 carbon atoms.

Examples of these organic compound lubricating agents include butyl caprylate, octyl caprylate, ethyl laurate, butyl laurate, octyl laurate, ethyl myristate, octyl myristate, 2-ethylhexyl myristate, ethyl palmitate, butyl palmitate, octyl palmirate, 2-ethylhexyl palmitate, ethyl stearate, butyl stearate, isobutyl stearate, octyl stearate, 2-ethylhexyl stearate, amyl stearate, isoamyl stearate, 2-ethylpentyl stearate, 2-hexyldecyl stearate, isotridecyl stearate, stearic acid amide, stearic acid alkyl amide, butoxyethyl stearate, anhydrosorbitan monostearate, anhydrosorbitan distearate, anhydrosorbitan tristearate, anhydrosorbitan tetrastearate, oleyl oleate, oleyl alcohol, lauryl alcohol, montan wax, and carnauba wax. The above-enumerated compounds may be used alone, or two or more of them may be used in combination.

Further, in the abrasive tape in accordance with the present invention, the so-called lubricating oil additives may be used as the lubricating agents. The lubricating oil additives may be used alone, or two or more of them may be used in combination. Examples of such lubricating oil additives include antioxidants known as anticorrosive agents (e.g., metal chelating agents, such as an alkyl phenol, benzotriazine, tetraazaindene, sulfamide, guanidine, nucleic acid, pyridine, amine, hydroquinone, and EDTA), rust preventives (e.g., naphthenic acid, alkenylsuccinic acid, and dilauryl phosphate), oiliness improvers (e.g., colza oil and lauryl alcohol), extreme pressure additives (e.g., dibenzyl sulfide, tricresyl phosphate, and tributyl phosphite), detergent-dispersants, viscosity index improvers, pour point depressants, and foaming preventives. These lubricating agents are added in proportions falling within the range of 0.01 to 30 parts by weight per 100 parts by weight of the binder.

As for these compounds, reference may be made to the compounds described in "IBM Technical Disclosure Bulletin", Vol. 9, No. 7, p. 779 (December 1966); "ELEKTRONIK", 1961, No. 12, p. 380; and "Kagaku Benran" (Chemical Handbook), application edition, pp. 954–967, 1980, Maruzen.

Further, in the present invention, as the dispersing agents and dispersion assisting auxiliaries, it is possible to employ fatty acids having 2 to 40 carbon atoms ($R_1COOH$, wherein $R_1$ represents an alkyl group, a phenyl group, or an aralkyl group, which has 1 to 39 carbon atoms), such as caprylic acid, capric acid, lauric acid, myristic acid, palmitic acid, stearic acid, oleic acid, elaidic acid, linoleic acid, linolenic acid, stearolic acid, behenic acid, maleic acid, and phthalic acid; salts of the above-enumerated fatty acids with alkali metals (Li, Na, K, and the like) or alkaline earth metals (Mg, Ca, Ba, and the like); metallic soaps comprising Cu, Pb, and the like, (e.g., copper oleate); fatty acid amides; and lecithins (e.g., soybean oil lecithin). As the dispersing agents and dispersion assisting auxiliaries, it is also possible to employ higher alcohols having 4 to 40 carbon atoms (e.g., butyl alcohol, octyl alcohol, myristyl alcohol, and stearyl alcohol), sulfuric esters of these higher alcohols, sulfonic acid, phenylsulfonic acids, alkylsulfonic acids, sulfonic esters, phosphoric monoesters, phosphoric diesters, phosphoric triesters, alkylphosphonic acids, phenylphosphonic acids, and amine compounds. As the dispersing agents and dispersion assisting auxiliaries, it is further possible to employ polyethylene glycols, polyethylene oxides, sulfosuccinic acid, sulfosuccinic acid metal salts, and sulfosuccinic esters. Ordinarily, one or more kinds of the dispersing agents are employed. One kind of the dispersing agent is added in proportions falling within the range of 0.005 to 20 parts by weight per 100 parts by weight of the binder. When the dispersing agent is used, it may be adhered to the surfaces of the fine abrasive grains or may be added during the dispersion process.

Examples of the mildew-proofing agents, which may be employed in the abrasive tape in accordance with the present invention, include 2-(4-thiazolyl)-benzimidazole, N-(fluorodichloromethylthio)-phthalimide, 10,10'-oxybisphenoxarsine, 2,4,5,6-tetrachloroisophthalonitrile, p-tolyldiiodomethylsulfone, triiodoallyl alcohol, dihydroacetonic acid, mercury phenyloleate, bis(tributyltin) oxide, and salicylanilide. Such compounds are described in, for example, "Microbial Calamity and Preventing Technique," published by Kogaku Tosho, 1972; and "Chemistry and Industry," Vol. 32, p. 904, 1979.

Examples of the antistatic agents other than carbon black, which may be employed in the abrasive tape in accordance with the present invention, include conductive grains, such as grains of graphite, modified graphite, carbon black graft polymer, tin oxide-antimony oxide, tin oxide, and titanium oxide-tin oxide-antimony oxide; natural surface active agents, such as saponin; nonionic surface active agents, such as an alkyleneoxide compound, a glycerin compound, a glycidol compound, a polyhydric alcohol, a polyhydric alcohol ester, and an adduct of an alkyl phenol with ethylene oxide; cationic surface active agents, such as a higher alkylamine, a cyclic amine, a hydantoin derivative, an amidoamine, an ester amide, a quaternary ammonium salt, a heterocyclic compound, e.g. pyridine, a phosphonium compound, and a sulfonium compound; anionic surface active agents containing acidic groups, such as a carboxylic acid group, a sulfonic acid group, a phosphonic acid group, a phosphoric acid group, a sulfuric ester group, a phosphonic ester group, and a phosphoric ester group; and amphoteric surface active agents, such as an amino acid, an amino sulfonic acid, a sulfate or a phosphate of an amino alcohol, and an alkyl betaine compound.

Several examples of the surface active agents, which may be employed as the antistatic agents, are described in, for example, "Synthesis and Applications of Surface Active Agents" by Ryohei Oda, et al., Tsubaki Shoten, 1972; "Surface Active Agents" by A. W. Bailey, Interscience Publication Incorporated, 1958; "Encyclopedia of Surface Active Agents, Vol. 2" by T. P. Sisley, Chemical Publish Company, 1964; "Surface Active Agent Handbook", sixth edition, Sangyo Tosho K. K., Dec. 20, 1966; and "Antistatic Agents" by Hideo Marushige, Saiwai Shobo, 1968.

The surface active agents may be used alone, or two or more of them may be used in combination. The proportions of the surface active agent in the abrasive layer should preferably fall within the range of 0.01 to 10 parts by weight per 100 parts by weight of the fine abrasive grains. In cases where the surface active agent is employed in the backing layer, it may be added in proportions falling within the range of 0.01 to 30 parts by weight per 100 parts by weight of the binder. These surface active agents are used as the antistatic agents. The surface active agents may also be used for purposes other than as the antistatic agents, for example, for dispersion, for improvement of lubricating properties, as coating assisting auxiliaries, as wetting agents, as hardening accelerators, and as dispersion accelerators.

In the abrasive tape in accordance with the present invention, organic solvents may be used in any proportion during the dispersing, kneading, and coating processes for the fine abrasive grains, the binder, and the like. Examples of such organic solvents include ketones, such as acetone, methyl ethyl ketone, methyl isobutyl ketone, cyclohexanone, and isophorone; alcohols, such as methyl alcohol, ethyl alcohol, propyl alcohol, butyl alcohol, isobutyl alcohol, isopropyl alcohol, and methylcyclohexanol; esters, such as methyl acetate, ethyl acetate, butyl acetate, isobutyl acetate, isopropyl acetate, ethyl lactate, and glycol acetate monoethyl ether; ethers, such as diethyl ether, tetrahydrofuran, ethylene glycol dimethyl ether, ethylene glycol monoethyl ether, and dioxane; aromatic hydrocarbons, such as benzene, toluene, xylene, cresol, chlorobenzene, and styrene; chlorinated hydrocarbons, such as methylene chloride, ethylene chloride, carbon tetrachloride, chloroform, ethylene chlorohydrin, and dichlorobenzene; N,N-dimethylformamide, and hexane.

Ordinarily, two or more of the above-enumerated organic solvents are used in combination in arbitrary proportions. The organic solvents may contain small amounts of impurities (e.g., polymerization products of the organic solvents, moisture, and raw material constituents of the organic solvents) in proportions of not larger than 1% by weight. Ordinarily, the organic solvents are used in proportions falling within the range of 100 to 20,000 parts by weight per 100 parts by weight of the total solids of the coating composition for the abrasive layer, or the coating composition for the backing layer, or the prime-coating composition. The solid contents of the coating composition should preferably fall within the range of 1% by weight to 40% by weight. The solid contents of the coating composition for the backing layer should preferably fall within the range of 1% by weight to 20% by weight. A water-based solvent (water, alcohol, acetone, or the like) may be employed in lieu of the organic solvents.

When the abrasive layer is to be formed, the constituents described above are selected appropriately and dispersed or dissolved in the organic solvents, and a coating composition is thereby prepared. The coating composition is applied onto the non-magnetic substrate and dried. If necessary, the coating composition is subjected to an orientation process. The thickness of the substrate falls within the range of 3 μm to 500 μm, and should preferably fall within the range of 4 μm to 300 μm. Also, the Young's modulus in either one of the longitudinal direction and the width direction of the non-magnetic substrate should preferably be at least 200 kg/mm$^2$. Examples of the materials for the non-magnetic substrate include polyesters, such as a polyethylene terephthalate and a polyethylene naphthalate; polyolefins, such as a polypropylene; cellulose derivatives, such as cellulose triacetate and cellulose diacetate; vinyl resins, such as a polyvinyl chloride; plastic materials, such as a polycarbonate, a polyimide, a polyamide, a polysulfone, a polyphenylsulfone, and a polybenzoxazole; metals, such as aluminum and copper; and ceramic materials, such as glass. Among the above-enumerated materials, the polyethylene naphthalate and the polyamide are preferable.

Before the coating composition is applied onto the substrate, the substrate may be subjected to corona discharge treatment, plasma treatment, prime-coating treatment, heat treatment, dust-resistant treatment, metal vapor evaporation treatment, and/or alkali treatment. The substrates are described in, for example, West Germany Patent No. 3338854A specification, Japanese Unexamined Patent Publication Nos. 59(1984)-116926 and 61(1986)-129731, U.S. Pat. No. 4,388,368, and "Fiber and Industry," by Yukio Mitsuishi, Vol. 31, pp. 50–55, 1975. The arithmetic mean deviation (Ra) of the substrate should preferably fall within the range of 0.001 μm to 1.5 μm (cut-off value: 0.25 mm).

No limitation is imposed on how the dispersing and kneading processes are carried out. The order, in which the constituents (the resins, the grains, the lubricants, the solvents, and the like) are added, the timing, with which the constituents are added during the dispersion and heading processes, the temperature at which the dispersion process is carried out (and which will ordinarily fall within the range of 0° C. to 80° C.), and the like, may be selected appropriately. One of various types of kneading machines may be used in order to prepare the coating composition for the abrasive layer and the coating composition for the backing layer. For example, it is possible to use a twin roll mill, a triple roll mill, a ball mill, a pebble mill, a trommel, a sand grinder, a Szegvari attritor, a high-speed impeller dispersing machine, a—high-speed stone mill, a high-speed impact mill, a disperser, a kneader, a high-speed mixer, a ribbon blender, a Ko-kneader, an intensive mixer, a tumbler, a blender, a homogenizer, a single-screw extruder, a twin-screw extruder, or an ultrasonic dispersing machine.

Ordinarily, a plurality of the dispersing and kneading machines are used, and the dispersing and kneading processes are carried out continuously. Details of the dispersing and kneading techniques are described in, for example, "Paint Flow and Pigment Dispersion," by T. C. Patton, John Wiley & Sons, 1964; "Industrial Materials," by Shin-ichi Tanaka, Vol. 25, p. 37, 1977; and literature cited in these publications. As auxiliary means for the dispersing and kneading techniques, steel balls, steel beads, ceramic beads, glass beads, and organic polymer beads, which have sizes equivalent to sphere diameters of 0.05 mm to 10 cm, may be used in order to carry out the dispersing and kneading processes efficiently. The shapes of these materials are not limited to spheres. These materials are described in, for example, U.S. Pat. Nos. 2,581,414 and 2,855,156. In the present invention, the coating composition for the abrasive layer and the coating composition for the backing layer may be prepared by carrying out the dispersing and kneading processes in accordance with the methods described in the aforesaid publications, the literature cited therein, and the like.

When the coating composition for the abrasive layer is to be applied onto the substrate, the viscosity of each coating composition may be adjusted at a value falling within the range of 1 to 20,000 centistrokes at 25° C. The coating composition may be applied onto the substrate by using any of coating apparatuses, for example, an air doctor coater, a blade coater, an air-knife coater, a squeeze coater, an impregnation coater, a reverse-roll coater, a transfer roll coater, a gravure coater, a kiss-roll coater, a cast coater, a spray coater, a rod coater, a forward-rotation roll coater, a curtain coater, an extrusion coater, a bar coater, or a lip coater. The other coating methods may also be used. The coating methods are described in, for example, "Coating Engineering," published by Asakura Shoten, pp. 253–277, Mar. 20, 1971. The order, in which the coating compositions are applied, may be selected arbitrarily. Before the desired coating composition is applied to the substrate, a prime-coating layer may be applied, or corona discharge treatment, or the like, may be carried out in order to enhance the adhesion to the substrate.

In cases where a plurality of abrasive layers or a plurality of backing layers are to be formed, simultaneous multi-layer coating, successive multi-layer coating, or the like, may be carried out. Such coating methods are described in, for example, Japanese Unexamined Patent Publication Nos. 57(1982)-123532, 59(1984)-142741, and 59(1984)-165239, and Japanese Patent Publication No. 62(1987)-37451.

With the methods described above, the coating composition for the abrasive layer is applied to a thickness of, for example, approximately 1 μm to approximately 100 μm on the substrate. The applied coating composition is then immediately dried in a plurality of steps at temperatures of 20° C. to 130° C., and thereafter the formed abrasive layer is dried to a thickness of 0.1 μm to 10 μm. At this time, ordinarily, conveyance of the substrate is carried out at a conveyance speed of 10 to 900 m/minute, the drying temperatures in a plurality of drying zones are adjusted at 20° C. to 130° C., and the amount of the solvent remaining in the coating film is set at 0.1 to 40 mg/m$^2$. When necessary, the backing layer may be formed with the same procedure. A surface smoothing process is then carried out in order to adjust the arithmetic mean deviation of the abrasive layer or the backing layer at 0.001 μm to 0.3 μm (cut-off value: 0.25 mm). The abrasive tape web is then cut into a desired shape, and the abrasive tape in accordance with the present invention is thereby produced.

In this case, pre-treatment and surface treatment of powder, kneading and dispersing, coating, orientation, drying, smoothing, heat treatment, EB treatment, surface cleaning, cutting, and winding processes should preferably carried out continuously. After the thus formed abrasive tape is cut, the abrasive tape is wound up around a plastic or metal reel. Immediately before the abrasive tape is wound up around the reel or in the process prior to the wind-up process, the abrasive layer, the backing layer, the edge faces, and the base surface of the abrasive tape should preferably be burnished and/or cleaned.

The burnishing process is carried out in order to adjust the surface roughness and the abrasive powder of the abrasive tape. Specifically, protrusions on the surface of the abrasive tape are scraped out, and the surface of the abrasive tape is thereby made uniform or smooth by using a hard material, such as a sapphire blade, a shaving blade, a hard material blade, a diamond blade, or a ceramic blade. No limitation is imposed on the hardness of the material used for the burnishing process, and any of materials, which can remove protrusions on the surface of the abrasive tape, may be employed. However, the Mohs hardness of the material used for the burnishing process should preferably be 8 or higher. The materials need not necessarily take on the form of blades and may have other shapes, such as square, round, and wheel shapes. (The material may be provided on the circumferential surface of a rotatable cylinder.)

The cleaning process is carried out in order to remove foreign substances, excessive lubricating agents, and the like, from the surface of the abrasive tape. For this purpose, the surface layers of the abrasive tape, i.e., the abrasive layer surface, the backing layer surface, the edge surfaces, the base surface on the back side, and the like, are wiped with a nonwoven fabric, or the like. As the wiping materials, it is possible to use, for example, various Vilene products supplied by Japan Vilene Co., Ltd., Toraysee and Ecsaine supplied by Toray Industries, Inc., a material available as Kimwipe (trade name), a nylon nonwoven fabric, a polyester nonwoven fabric, a rayon nonwoven fabric, an acrylonitrile nonwoven fabric, a mixed nonwoven fabric, and tissue paper.

As for the fine abrasive grains, the non-magnetic grains, the binders, the additives (such as lubricating agents, dispersing agents, antistatic agents, surface treatment agents, carbon black, light blocking agents, antioxidants, and mildew-proofing agents), the solvents, and/or substrates (which may be provided with a prime-coating layer, a backing layer, and a back prime-coating layer), which may be utilized for the abrasive tape in accordance with the present invention, and how to prepare these constituents, reference may be made to, for example, the method for making a magnetic recording medium, which is disclosed in Japanese Patent Publication No. 56(1981)-26890.

EXAMPLES

The present invention will further be illustrated by the following examples. It will be apparent to experts in the art that the kinds and proportions of the constituents, working procedures, and the like, described in the examples may be varied without departing from the spirit and scope of the present invention. Therefore, the present invention is not limited to the examples described below. In these examples, the term "parts" means parts by weight.

Examples 1 Through 6

A prime-coating layer constituted of a polyester polyurethane resin was applied to a thickness of 0.5 μm onto a polyethylene terephthalate (PET) substrate having a thickness of 30 μm. An abrasive coating composition was prepared by kneading the constituents described below with an open kneader and adding a diluting agent with an agitator in order to adjust the viscosity. The abrasive coating composition was applied with a doctor blade onto the prime-coating layer such that the dry thickness of the abrasive layer might be 15 μm. In this manner, samples of Examples 1, 2, 3, 4, 5, and 6 were prepared. These samples differed from one another in the value of X parts by weight shown below. The values of X listed in Table 1 below were employed. Also, in Comparative Example 1, a sample, to which dioctyl sodium sulfosuccinate serving as the wetting agent was not added, was prepared.

| | |
|---|---|
| Abrasive grains (granular alumina, mean grain diameter: 6 μm, Mohs hardness: 9) | 100 parts |
| Binder (polyester, containing sodium sulfonate in a proportion of $2 \times 10^{-3}$ equivalents per g of the resin, Mw: 70,000) | 12 parts |
| Binder (polyisocyanate, a reaction product of 3 mols of tolylene diisocyanate with 1 mol of trimethylolpropane) | 3 parts |
| Carbon (Conductex SC) | 1 part |
| Dispersing agent (oleic acid/oleyl oleate) | 0.1 part |
| Wetting agent (dioctyl sodium sulfosuccinate) | X parts |
| Solvent (methyl ethyl ketone/cyclohexanone = 2/1) | 200 parts |
| Diluting agent (toluene/MIBK) | 150 parts |

The dioctyl sodium sulfosuccinate is one of the alkyl sulfosuccinic acid salt esters, which may be represented by the formula shown below.

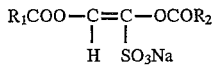

wherein $R_1$ and $R_2$ may be identical or different.

Besides dioctyl, the alkyl group may be isopropyl, 2-ethylhexyl, isobutyl, 1-methyl-4-ethylhexyl, 1-methylheptyl, 1-isobutyl-3-methylbutyl, n-heptyl, n-octyl, or the like.

Each sample of the abrasive tape was then processed so as to have a width of 12.65 mm. FIG. 1 is a schematic view showing an embodiment of the abrasive tape in accordance with the present invention. As illustrated in FIG. 1, the abrasive tape comprises a substrate 10 and an abrasive layer 20 overlaid on the substrate 10. The abrasive layer 20 comprises a binder 21 and alumina grains 22 serving as the fine abrasive grains and dispersed in the binder 21. The abrasive layer 20 also contains the dioctyl sodium sulfosuccinate.

Abrasive processing was carried out on the surfaces of ferrite heads for video tape recorders by using each of the abrasive tapes of Examples 1 through 6 and Comparative Example 1. The depths of abrasion were as listed in Table 1 below. The conditions of the abrasive processing were such that the tape feed rate was 40 mm/second, the tape tension was 100 g, and the abrasive processing time was 5 seconds. Also, the ferrite head after being subjected to the abrasive processing with each abrasive tape was set in a video tape recorder, and the reproduction output power at a frequency of 7 MHz was investigated. The results shown in Table 1 were obtained.

TABLE 1

| | Value of X (parts) of dioctyl sodium sulfosuccinate | Depth of abrasion (μm) | Output Power (dB) |
|---|---|---|---|
| Comp. Ex. 1 | 0 | 20 | 0 (Reference) |
| Example 1 | 0.05 | 50 | 0 |
| Example 2 | 0.1 | 60 | 0 |
| Example 3 | 0.5 | 60 | 0 |
| Example 4 | 1.0 | 60 | 0 |
| Example 5 | 2.0 | 65 | 0 |
| Example 6 | 4.0 | 40 | −1.0 |

As is clear from Table 1, the abrasive tapes in accordance with the present invention (i.e., the abrasive tapes of Examples 1 through 6) have the abrasive powder not lower than the abrasive powder of the abrasive tape (i.e., the abrasive tape of Comparative Example 1) having the abrasive layer containing no dioctyl sodium sulfosuccinate. In particular, the abrasive tapes of Examples 2, 3, 4, and 5, in which the dioctyl sodium sulfosuccinate is contained in proportions falling within the range of 0.1 to 2.0 parts by weight per 100 parts by weight of the fine abrasive grains, have the abrasive powder markedly higher than the abrasive powder of the abrasive tape of Comparative Example 1. Also, when the ferrite heads having been subjected to the abrasive processing with the abrasive tapes in accordance with the present invention (i.e., the abrasive tapes of Examples 1 through 6) are used, little reduction in output power occurs. This indicates that scratches or chipping did not occur on the ferrite heads having been subjected to the abrasive processing with the abrasive tapes in accordance with the present invention.

Examples 7 Through 12

A prime-coating layer constituted of a polyester polyurethane resin was applied to a thickness of 0.5 μm onto a polyethylene terephthalate (PET) substrate having a thickness of 25 μm. An abrasive coating composition was preparedby kneading the constituents described below with an open kneader and adding a diluting agent with an agitator in order to adjust the viscosity. The abrasive coating composition was applied with a doctor blade onto the prime-coating layer such that the dry thickness of the abrasive layer might be 10 μm. In this manner, samples of Examples 7, 8, 9, 10, 11, and 12 were prepared. These samples differed from one another in the value of X parts by weight shown below. The values of X listed in Table 2 below were employed. Also, in Comparative Example 2, a sample, to which dioctyl sodium sulfosuccinate serving as the wetting agent was not added, was prepared.

Abrasive Coating Composition:

| | |
|---|---|
| Abrasive grains (granular alumina, mean grain diameter: 2 μm, Mohs hardness: 9) | 100 parts |
| Binder (polyester, containing sodium sulfonate in a proportion of $2 \times 10^{-3}$ equivalents per g of the resin, Mw: 70,000) | 18 parts |
| Binder (Polyisocyanate, a reaction product of 3 mols of tolylene diisocyanate with 1 mol of trimethylolpropane) | 5 parts |
| Carbon (Conductex SC) | 1 part |
| Wetting agent (dioctyl sodium sulfosuccinate) | X parts |
| Solvent (methyl ethyl ketone/cyclohexanone = 2/1) | 200 parts |
| Diluting agent (toluene/MIBK) | 150 parts |

Each sample of the abrasive tape was then processed so as to have a width of 1.5 inches. Also, in this case, in the abrasive tapes in accordance with the present invention (i.e., the abrasive tapes of Examples 7 through 12), the dioctyl sodium sulfosuccinate is contained in the abrasive layer.

A texturing process was carried out on Ni-P-plated Al substrates for hard disks by using each of the abrasive tapes of Examples 7 through 12 and Comparative Example 2. Thereafter, the surface roughness of each Al substrate having been subjected to the texturing process was measured. The results shown in Table 2 below were obtained. In Table 2, Ra represents the arithmetic mean deviation, and Ry represents the maximum surface roughness. The conditions of the abrasive processing were such that the tape feed rate was 40 mm/second, and disk rotation speed was 100 rpm.

TABLE 2

| | Value of X (parts) of | Surface characteristics of Al substrate | | |
|---|---|---|---|---|
| | dioctyl sodium sulfosuccinate | Ra (nm) | Ry (nm) | Ry/Ra |
| Comp. Ex. 2 | 0 | 8.0 | 90 | 11.3 |
| Example 7 | 0.05 | 8.0 | 72 | 9.0 |
| Example 8 | 0.1 | 8.0 | 48 | 6.0 |
| Example 9 | 0.5 | 8.0 | 48 | 6.0 |
| Example 10 | 1.0 | 8.0 | 48 | 6.0 |
| Example 11 | 2.0 | 8.0 | 48 | 6.0 |
| Example 12 | 4.0 | 8.0 | 64 | 8.0 |

The maximum surface roughness Ry of the substrate takes a large value when there are many scratches on the surface of the substrate. The Ry values of the substrates having been subjected to the abrasive processing with the abrasive tapes in accordance with the present invention (i.e., the abrasive tapes of Examples 7 through 12) are distinctly smaller than the Ry value of the substrate having been subjected to the abrasive processing with the abrasive tape (i.e., the abrasive tape of Comparative Example 2), which has the abrasive layer containing no dioctyl sodium sulfosuccinate. In particular, the Ry values of the substrates having been subjected to the abrasive processing with the abrasive tapes of Examples 8, 9, 10, and 11, in which the dioctyl sodium sulfosuccinate is contained in proportions falling within the range of 0.1 to 2.0 parts by weight per 100 parts by weight of the fine abrasive grains, are markedly small. This indicates that the abrasive tapes in accordance with the present invention have high effects of preventing the occurrence of scratches.

What is claimed is:

1. An abrasive tape comprising a substrate and an abrasive layer, said layer overlaid on the substrate and comprising fine abrasive grains and a binder, wherein the abrasive layer contains an alkyl sulfosuccinic acid salt ester.

2. An abrasive tape as defined in claim 1 wherein the alkyl group in the alkyl sulfosuccinic acid salt ester has 3 to 10 carbon atoms.

3. An abrasive tape as defined in claim 1 wherein the alkyl sulfosuccinic acid salt ester is dioctyl sodium sulfosuccinate, and dioctyl sodium sulfosuccinate is contained in a proportion falling within the range of 0.1 to 2.0 parts by weight per 100 parts by weight of the fine abrasive grains.

4. An abrasive tape as defined in claim 1 wherein the salt is selected from the group consisting of the salts of alkali metals and the salts of alkaline earth metals.

5. An abrasive tape as defined in claim 1 wherein the substrate is a non-magnetic substrate.

6. An abrasive tape as defined in claim 1 wherein the fine abrasive grains have a mean grain size falling within the range of 0.05 μm to 10 μm.

7. An abrasive tape as defined in claim 1 wherein the fine abrasive grains have a pH value falling within the range of 2 to 10.

8. An abrasive tape as defined in claim 1 wherein the substrate has a Young's modulus, in either one of the longitudinal direction and the width direction, which is at least 200 kg/mm$^2$.

9. An abrasive tape as defined in claim 1 wherein the substrate of a film selected from the group consisting of a polyethylene naphthalate film and a polyamide film.

10. An abrasive tape as defined in claim 1 wherein the substrate falls has a thickness which within the range of 3 μm to 500 μm.

11. An abrasive tape as defined in claim 2 wherein the alkyl sulfosuccinic acid salt ester is dioctyl sodium sulfosuccinate, and dioctyl sodium sulfosuccinate is contained in a proportion falling within the range of 0.1 to 2.0 parts by weight per 100 parts by weight of the fine abrasive grains.

* * * * *